US009656157B2

(12) United States Patent
Shelburn et al.

(10) Patent No.: US 9,656,157 B2
(45) **Date of Patent: *May 23, 2017**

(54) ROULETTE MODIFICATION SYSTEM AND WAGERING METHODS

(71) Applicant: AGS, LLC, Las Vegas, NV (US)

(72) Inventors: Timothy J. Shelburn, Las Vegas, NV (US); Tony Wonnacott, Toronto (CA)

(73) Assignee: AGS, LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/549,914

(22) Filed: Nov. 21, 2014

(65) Prior Publication Data

US 2015/0157927 A1 Jun. 11, 2015

Related U.S. Application Data

(63) Continuation of application No. 13/595,392, filed on Aug. 27, 2012, now Pat. No. 8,899,586.

(60) Provisional application No. 61/527,247, filed on Aug. 25, 2011.

(51) Int. Cl.

| | |
|---|---|
| ***A63F 1/18*** | (2006.01) |
| ***A63F 5/00*** | (2006.01) |
| *A63F 7/24* | (2006.01) |
| *A63F 7/26* | (2006.01) |

(52) U.S. Cl.

CPC ..... *A63F 5/0088* (2013.01); *A63F 5/00* (2013.01); *A63F 7/2472* (2013.01); *A63F 7/26* (2013.01)

(58) Field of Classification Search

CPC ..... A63B 71/00; A63F 1/18

USPC ..... 273/142 E

See application file for complete search history.

(56) References Cited

U.S. PATENT DOCUMENTS

| | | | | |
|---|---|---|---|---|
| 5,031,966 | A * | 7/1991 | Oakey | B60B 3/06 301/37.11 |
| 5,102,135 | A | 4/1992 | Addiechi | |
| 5,437,452 | A | 8/1995 | Graf et al. | |
| 5,564,791 | A * | 10/1996 | Chase | B60B 5/02 301/5.21 |
| 5,588,650 | A | 12/1996 | Eman et al. | |
| 5,597,213 | A * | 1/1997 | Chase | B60B 7/00 301/37.11 |
| 5,755,440 | A | 5/1998 | Sher | |
| 5,775,993 | A * | 7/1998 | Fentz | G07F 17/3262 463/17 |

(Continued)

FOREIGN PATENT DOCUMENTS

| | | |
|---|---|---|
| GB | 2 4387 55 | 12/2007 |
| GB | 2441745 | 3/2008 |
| TW | 201 023 954 | 7/2010 |

OTHER PUBLICATIONS

European Search Report for application No. 12825569.2 mailed Mar. 30, 2015 in 3 pages.

(Continued)

*Primary Examiner* — Aarti B Berdichevsky
*Assistant Examiner* — Dolores Collins
(74) *Attorney, Agent, or Firm* — Weide & Miller, Ltd.

(57) ABSTRACT

Systems, methods and apparatus which provides for modified roulette games, and various wagering options, in which one or more roulette balls are propelled onto a spinning roulette wheel, among other things, including a roulette wheel overlay apparatus and system and associated table layouts.

19 Claims, 10 Drawing Sheets

(56) References Cited

U.S. PATENT DOCUMENTS 5,836,583 A 11/1998 Towers
6,042,114 A * 3/2000 Phillip ..... A63F 5/02 273/142 D
6,082,829 A * 7/2000 Chase ..... B60B 7/008 301/37.11
6,209,869 B1 * 4/2001 Mathews ..... A63F 5/00 273/138.1
6,497,409 B2 * 12/2002 Mathews ..... A63F 5/00 273/138.1
6,659,866 B2 12/2003 Frost et al.
6,733,388 B2 5/2004 Mothwurf
6,869,359 B1 * 3/2005 Mathews ..... G07F 17/32 273/138.2
6,908,385 B2 * 6/2005 Green ..... G07F 17/3241 463/16
7,281,978 B2 10/2007 Moshal
7,318,628 B2 1/2008 Guile
7,448,948 B2 11/2008 Hughs-Baird et al.
7,553,233 B2 * 6/2009 Jarvis ..... G07F 17/32 463/17
7,669,850 B1 3/2010 Miller
7,850,171 B2 * 12/2010 Bontempo ..... A63F 5/00 273/142 H
7,946,912 B1 5/2011 Rennard
8,006,978 B2 8/2011 Bontempo et al.
8,142,283 B2 * 3/2012 Lutnick ..... G07F 17/32 463/16
8,147,316 B2 * 4/2012 Arezina ..... G07F 17/3206 463/20
8,152,171 B2 * 4/2012 Miltenberger ..... A63F 5/00 273/142 E
8,210,942 B2 * 7/2012 Shimabukuro ..... G07F 17/3209 200/314
8,226,085 B2 7/2012 Bontempo et al.
8,256,771 B2 * 9/2012 Marquez ..... A63F 5/00 273/138.1
8,333,655 B2 * 12/2012 Gagner ..... G07F 17/32 463/25
8,348,747 B2 * 1/2013 Arezina ..... G07F 17/3206 463/20
D688,315 S * 8/2013 Shelburn ..... D21/375
D688,316 S * 8/2013 Shelburn ..... D21/375
8,517,381 B2 * 8/2013 Bontempo ..... A63F 5/00 273/142 HA
8,518,382 B2 * 8/2013 Speronello ..... A61K 8/22 424/49
8,562,412 B2 10/2013 Matsuno
8,651,939 B2 * 2/2014 Nordman ..... G07F 17/32 273/138.1
8,758,111 B2 * 6/2014 Lutnick ..... G07F 17/3276 273/292
8,986,106 B2 * 3/2015 Nicely ..... G07F 17/326 463/25
2005/0014550 A1 1/2005 Rhoten
2007/0060247 A1 3/2007 Low et al.
2008/0113713 A1 5/2008 Fujimoto
2010/0102507 A1 4/2010 Bontempo et al.
2011/0059785 A1 3/2011 Scalisi
2013/0059647 A1 * 3/2013 Nicely ..... G07F 17/326 463/25

OTHER PUBLICATIONS

International Search Report and Written Opinion (Date of Mailing Jan. 8, 2013).

* cited by examiner

ROULETTE MODIFICATION SYSTEM AND WAGERING METHODS

RELATED APPLICATION DATA

This application is a continuation of U.S. patent application Ser. No. 13/595,392, filed Aug. 27, 2012, and claims the benefit of U.S. Provisional Patent Application No. 61/527,247 which was filed Aug. 25, 2011

BACKGROUND OF THE INVENTION

The invention is directed to wagering games, and more particularly, roulette games typically found in gaming establishments, such as those involving a roulette wheel, playing surface, playing positions for multiple players, playing cards, and a dealer, or virtual representations thereof.

Roulette is a well-known casino game which has been played for many years. A typical roulette game consists of a table with betting layout adjacent to a roulette wheel rotor or ring mounted for rotational motion within a support structure. The ring includes a circular array of numbered segments bearing numbers 1 through 36 defined on its upper surface. American Roulette wheels typically have rings which also include the numbers 0 and 00 disposed at diametrically opposite locations on the upper surface, whereas European Roulette wheels include only the number 0. The numbers 1 through 36 are not disposed in numerical order, but rather are typically disposed in a predetermined arrangement, such that roulette wheels located in different casinos will have the same standard predetermined number ring arrangement. The numbers disposed in a circular array in the number ring region of the wheel bear the alternating colors of red and black, with the exception of the 0 and/or 00 numbers, which are typically colored green. A ring of pockets corresponding in number to the plurality of numbers of the ring lies adjacent, but radially inward of the ring, on the typical roulette wheel. A typical roulette wheel further includes a circular, inclined ball track radially outwardly of the ring.

In operation of a typical roulette game, players place chips or tokens on a betting layout located on a roulette table, and then the croupier or dealer spins the roulette wheel and the roulette ball is placed in motion along the circular ball track in the opposite direction of the rotation of the wheel. As the wheel slows, the ball moves radially inwardly and comes to rest in one of the pockets associated with a particular one of the numbers of the number ring. After the ball comes to rest in one of the pockets, the croupier or dealer settles the various wagers placed on the table layout in accordance with predetermined rules and wager odds and the process is repeated.

Gaming establishments or casinos continually require new games to offer their players. Players are typically attracted to games that provide relatively decent odds of winning, as compared with other casino games, and can be played rapidly. It has been found that many of the games which have been successful also offer lively game play features that further serve to heighten player interest in such games. Naturally, casino operators seek to provide the most popular games for their gaming patrons.

SUMMARY OF THE INVENTION

In some embodiments, the invention is generally directed to a system and method for providing a roulette game, and various wagering options, in which one or more roulette balls propelled onto a spinning roulette wheel.

Some embodiments of the invention are directed to a roulette overlay apparatus and system comprising: a support body including an annular portion defining a central circular space therein, the annular portion including a first side having a peripheral rim and an opposing second side having an annular receiving channel defined at least partially by a radially inner sidewall and a radially outer sidewall, wherein the annular receiving channel is dimensioned and configured to be seated on a stationary bowl of a conventional roulette wheel; a ball propelling device mounted on the support body and including a receiving port for receiving one or more balls to be propelled; and a ball guiding member connected with the ball propelling device for receiving one or more propelled balls and having an end positioned for guiding the one or more propelled balls into the central circular space.

In some embodiments, the aforementioned roulette overlay system further includes an actuator for causing the ball propelling device to propel one or more balls mounted on the support body.

In some embodiments, the aforementioned roulette overlay system further includes a ball guiding member which comprises an elongated tube. The ball guiding member may extend along the peripheral rim and have an end positioned within the central circular space.

In some embodiments, the aforementioned roulette overlay system further includes a remote actuator for causing the ball propelling device to propel one or more balls.

In some embodiments, the aforementioned roulette overlay system further includes an audio device configured for playing audio upon one or more balls being propelled.

In some embodiments, the ball propelling device is adjustable, and may be configured to propel two or more balls consecutively within a preset range of time or configured to propel two or more balls substantially simultaneously, for example.

Some embodiments of the invention are directed to a roulette overlay system and associated multiball roulette wagering game, comprising: a support body including an annular portion defining a central circular space therein, the annular portion including a first side having a peripheral rim and an opposing second side having an annular receiving channel defined at least partially by a radially inner sidewall and a radially outer sidewall, wherein the annular receiving channel is dimensioned and configured to be seated on a stationary bowl of a conventional roulette wheel; a ball propelling device mounted on the support body and including a receiving port for receiving at least two balls to be propelled; a ball guiding member connected with the ball propelling device for receiving propelled balls and having an end positioned for guiding the propelled balls into the central circular space; and a table layout displaying wagering areas and indicia relating to wagering opportunities for the associated multiball roulette wagering game.

In some embodiments of the aforementioned roulette overlay system and associated game, the ball propelling device is configured to propel two or more balls substantially simultaneously.

In some embodiments, the aforementioned roulette overlay system and associated game further includes a conventional roulette wheel seated within the central circular space and mounted for rotational motion in the stationary bowl.

In some embodiments, the aforementioned roulette overlay system and associated game further includes an interface with a display for displaying the table layout.

In some embodiments, the aforementioned roulette overlay system and associated game further includes an actuator for causing the ball propelling device to propel one or more balls mounted on the support body.

In some embodiments of the aforementioned roulette overlay system and associated game, the ball guiding member comprises an elongated tube and may further include a remote actuator for causing the ball propelling device to propel one or more balls.

In some embodiments of the aforementioned roulette overlay system and associated game, the ball propelling device is configured to propel the two or more balls consecutively within a preset range of time.

In some embodiments of the aforementioned roulette overlay system and associated game, the ball propelling device is configured to propel the two or more balls substantially simultaneously.

Some embodiments of the invention are also directed to a method for providing a multiball roulette wagering game comprising the steps of: displaying wagering areas and indicia relating to wagering opportunities for the multiball roulette wagering game including indicia and wagering areas relating to a doubleball wager; receiving one or more wagers relating to the result of the game, wherein each wager includes a monetary amount and an identification of at least one the following: a color, a number, a plurality of numbers and a doubleball wager number; spinning a roulette wheel mounted for rotational movement in a first direction; propelling at least two balls onto a spinning roulette wheel in a second direction opposing the first direction; permitting the roulette wheel to lose momentum until the at least two balls come to rest in one or more pockets; determining the game result based on the color and number of the one or more pockets in which the at least two balls come to rest; comparing the game result with the identification associated with each wager, wherein the doubleball wager is a winning wager if at least two balls come to rest in a single pocket corresponding to the doubleball wager number identified; and resolving each wager by either awarding a payout if the identification associated with the wager matches the game result or collecting the wager if the identification associated with the wager does not match the game result.

In some embodiments, the step of propelling at least two balls onto a spinning roulette wheel in a second direction opposing the first direction in the aforementioned method further includes actuating a ball propelling device using a remote actuator to cause the propelling of the two balls.

In some embodiments, the aforementioned method further includes the step of playing a preset audio from an audio device upon actuating the ball propelling device.

DETAILED DESCRIPTION OF THE INVENTION

In the following detailed description, reference is made to the accompanying drawings which form a part of this application. The drawings provide and illustrate specific exemplary embodiments in which the invention may be practiced. It is to be understood that other embodiments may be utilized and structural changes may be made without departing from the scope of the invention.

Figure 1:
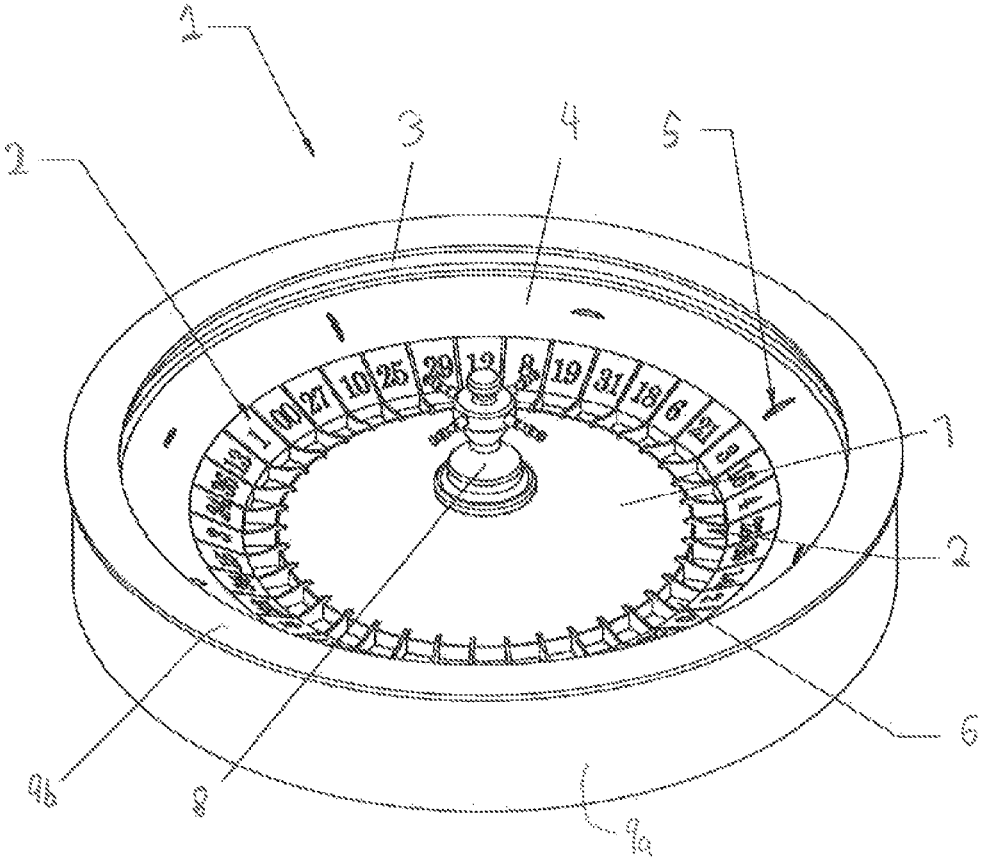
FIG. 1 is a perspective view of a conventional roulette wheel.
Figure 2:
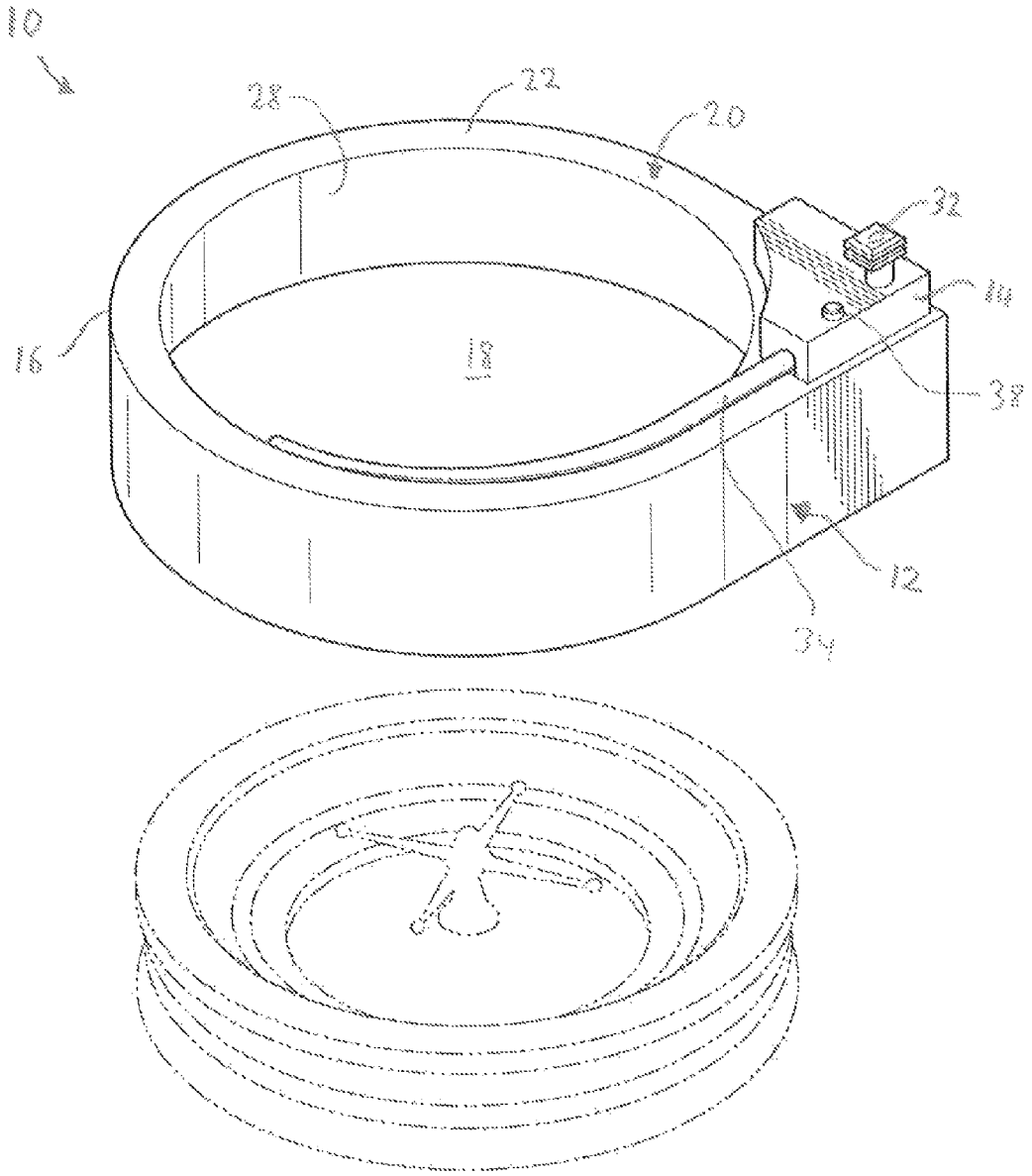
FIG. 2 is perspective view of an exemplary roulette wheel overlay apparatus and system constructed in accordance with some embodiments of the invention with the broken lines illustrating an exemplary roulette wheel assembly.
Figure 3:
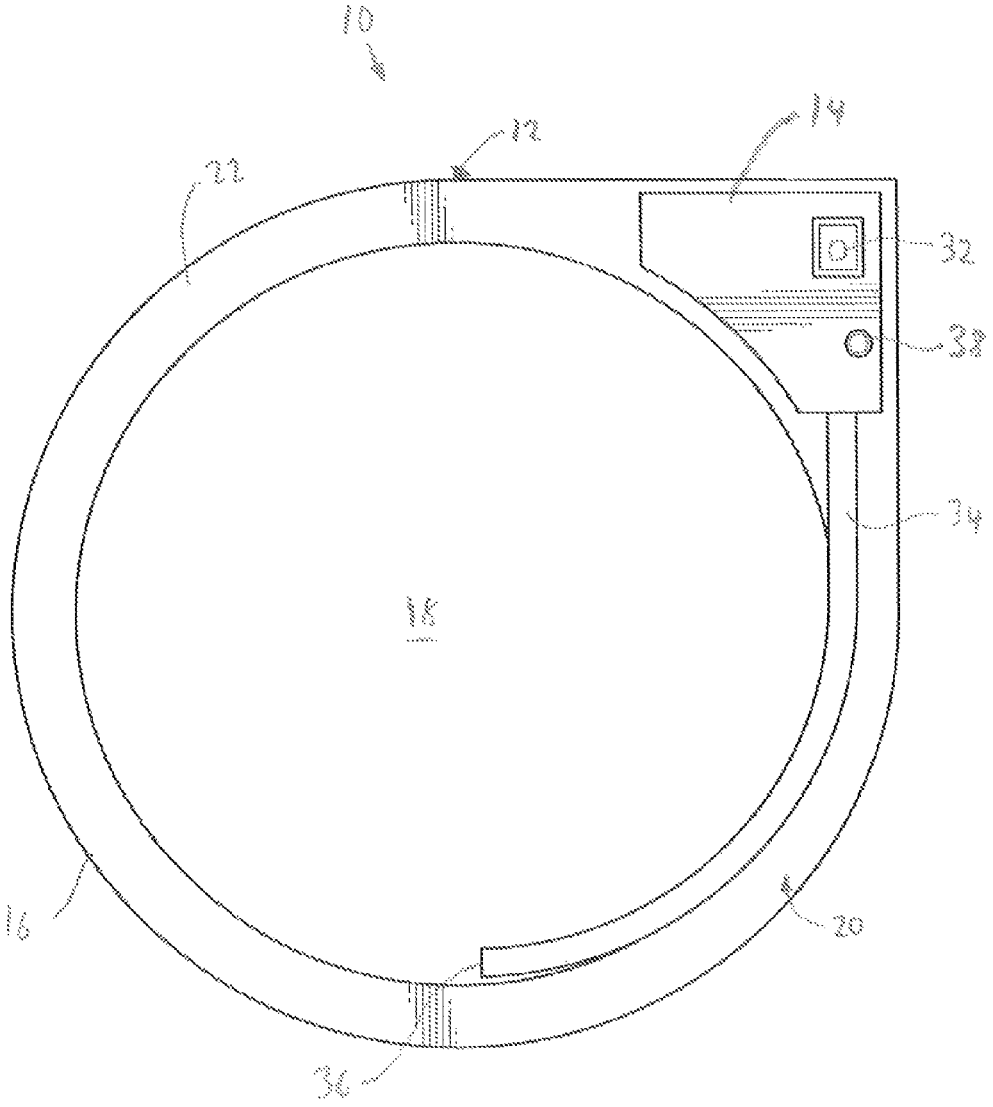
FIG. 3 is a top view of the exemplary roulette wheel overlay apparatus and system shown in FIG. 2.
Figure 4:
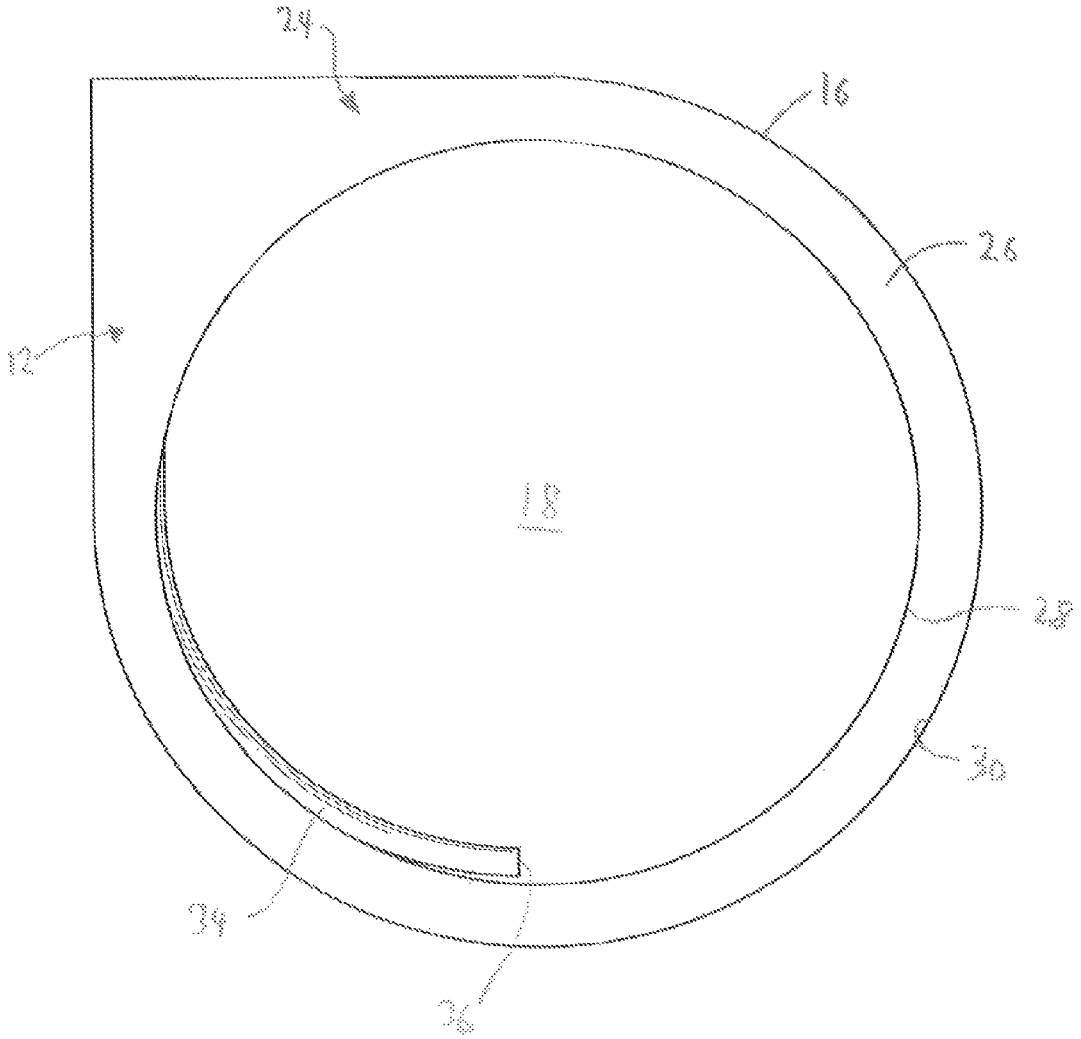
FIG. 4 is a bottom view of the exemplary roulette wheel overlay apparatus and system shown in FIG. 2.
Figure 5:
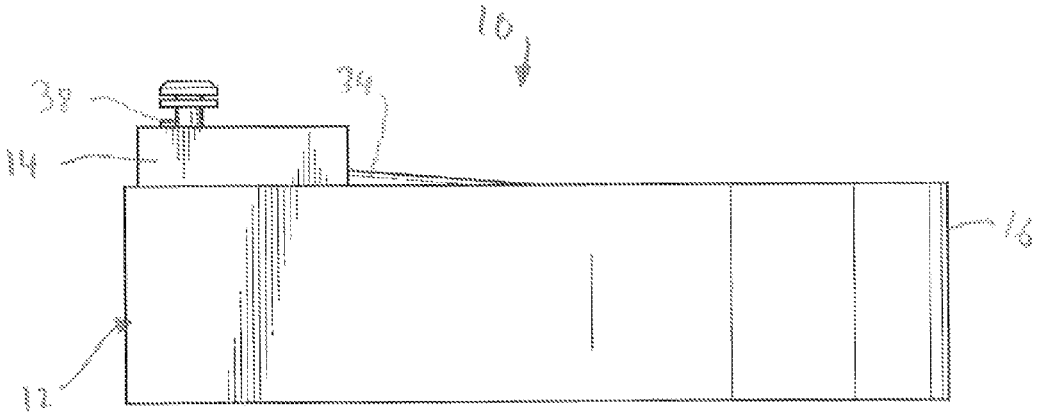
FIG. 5 is a side elevational view of the exemplary roulette wheel overlay apparatus and system shown in FIG. 2.
Figure 6:
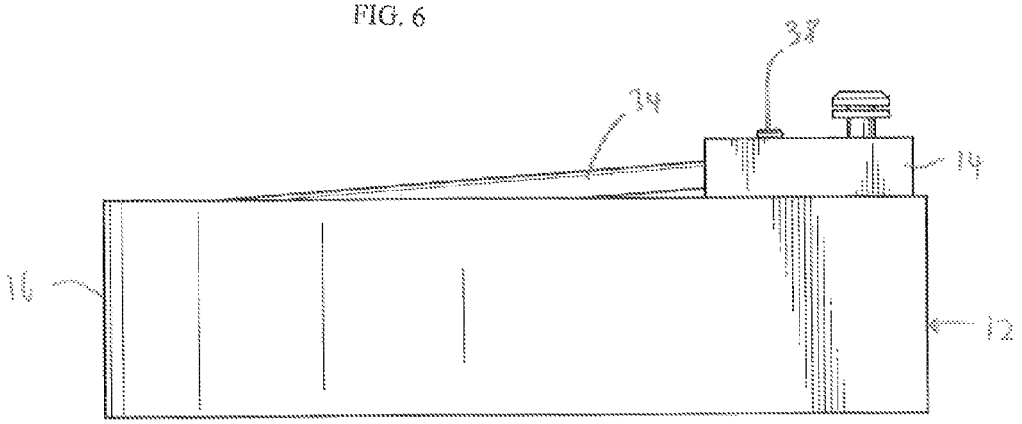
FIG. 6 is a side elevational view of the exemplary roulette wheel overlay apparatus and system shown in FIG. 2.
Figure 7:
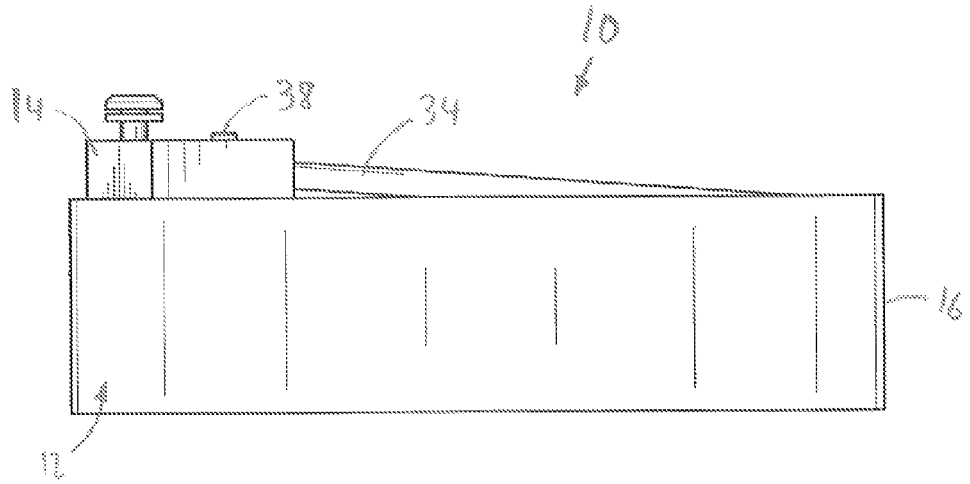
FIG. 7 is a front elevational view of the exemplary roulette wheel overlay apparatus and system shown in FIG. 2.
Figure 8:
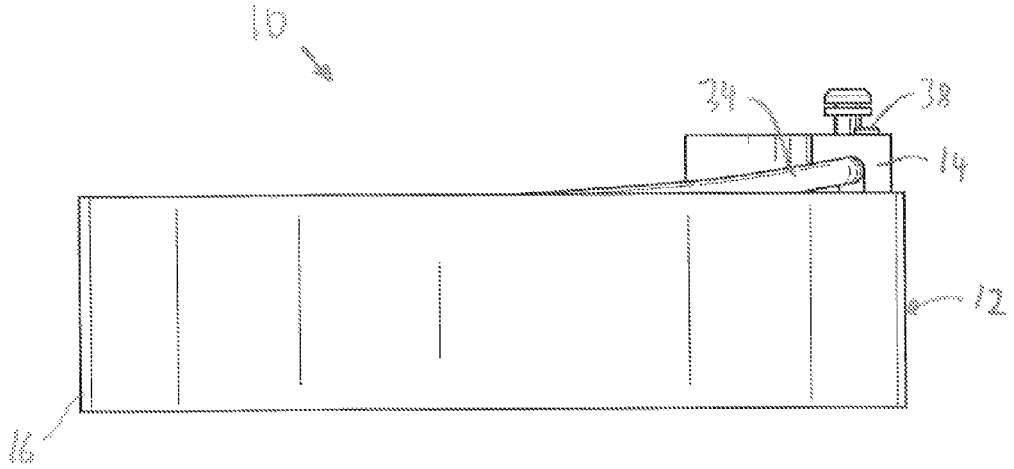
FIG. 8 is a rear elevational view of the exemplary roulette wheel overlay apparatus and system shown in FIG. 2.

FIG. 1 shows a conventional American style roulette wheel apparatus 1. To play roulette, the croupier first spins the wheel 2 in one direction and then spins a ball in upper ball track 3 in the opposite direction of the spinning wheel 2. Upper ball track 3 is slightly tilted toward the center, so that as the ball slows in the upper ball track 3, gravity will cause the ball to fall out onto the lower ball track 4. Rigidly mounted on the lower ball track are horizontal and vertical ball deflectors 5 designed to disrupt the smooth path of the ball and add a random variable to the path of the ball. As the ball continues to slow, gravity causes it to move toward the wheel 2. Wheel 2 includes thirty-eight pockets 6 separated by pocket dividers. The ball may then fall into any pocket 6, hit a pocket divider and bounce either back onto lower ball track 4, onto cone 7 or into another pocket 6. Eventually a ball will fall into a pocket 6 and stay there. The winning number is the number associated with the pocket in which the ball finally comes to rest. Turret 8 is primarily decoration that covers internal parts which may relate to a central spindle (not shown) upon which wheel 2 is mounted. All of the various parts are supported and contained in a stationary bowl 9*a* having an upper annular rim 9*b*.

FIGS. 2-8 illustrate an exemplary roulette wheel overlay apparatus and system constructed in accordance with the invention and generally referred to by the reference numeral 10. System 10 includes a support body 12 with an area thereof referred to herein as housing portion 14 and an annular portion 16 which defines an interior central circular space 18 therein. Annular portion 16 includes a top or first side 20 with a peripheral rim 22 and an opposing bottom or second side 24 with a substantially annular receiving channel 26 defined by a radially inner sidewall 28 and radially outer sidewall 30. Annular receiving channel 26 is configured and dimensioned to facilitate seating system 10 on the upper annular rim 9*b* of stationary bowl 9*a*. In some embodiments, annular receiving channel 26 and/or the interior of sidewalls 28 and 30 may further include one or more materials that have various properties, such as materials that are flexible, pliant, provide cushion or dampen or reduce vibrations for example, upon being seated on upper annular rim 9*b* and stationary bowl 9*a*.

Housing portion 14 includes a ball propelling device (not shown) mounted therein which has an entry port 32 for receiving one or more balls located on the exterior of support body 12. A ball guiding member 34 is connected with the ball propelling device to receive one or more balls propelled therefrom and guide the one or more propelled balls into central circular space 18 via a ball guiding member exit 36. In this embodiment, ball guiding member 34 is a generally arcuate tube which extends partially along peripheral rim 22 and radically inner sidewall 28 so that exit 36 is located adjacent to radially inner side wall 28. Thus, upon system 10 being seated on stationary bowl 9*a*, roulette wheel 2 would be within central circular space 18 and exit 36 would guide propelled balls generally along the inner circumferences of upper ball track 3.

The ball propelling device may be any device which is capable of applying sufficient force to cause one or more balls to be propelled consistently at an appropriate velocity each time for use with a conventional roulette wheel, such as a physical method like a springing hammer or a "butterfly" ball firing mechanism, or a non-physical method, such as a pressurized air ejector. The ball propelling device may be configured to propel one or more balls through ball guiding member 34 either substantially at the same time or consecutively within a range of time from one another, which may be preset, such as a fraction of a second. An actuator 38 for the ball propelling device is positioned on the exterior of support body 12, which in this embodiment comprises a depressible button.

In some embodiments, system 10 and the ball propelling device may be configured to receive an actuation signal from a remote device, such as a handheld device with a depressible button, which would facilitate a dealer, croupier passing the remote device to players so that players may alternately actuate the ball propelling device during play of a roulette game in order to propel one or more balls through the ball guiding member 34 and into central circular space 18 wherein roulette wheel 2 may be spinning.

Housing portion 14 may also include various electronic and/or electromechanical devices mounted therein, which may also be operatively associated with one another, such as one or more tamper sensors, a communication device for either receiving a signal to actuate the roulette ball propelling device and an audio device for playing audio, such as the sound of an instrument, gunshot, siren, bell or spoken words, which may occur upon actuating the ball propelling device, during game play or to attract attention at other times.

Figure 9:
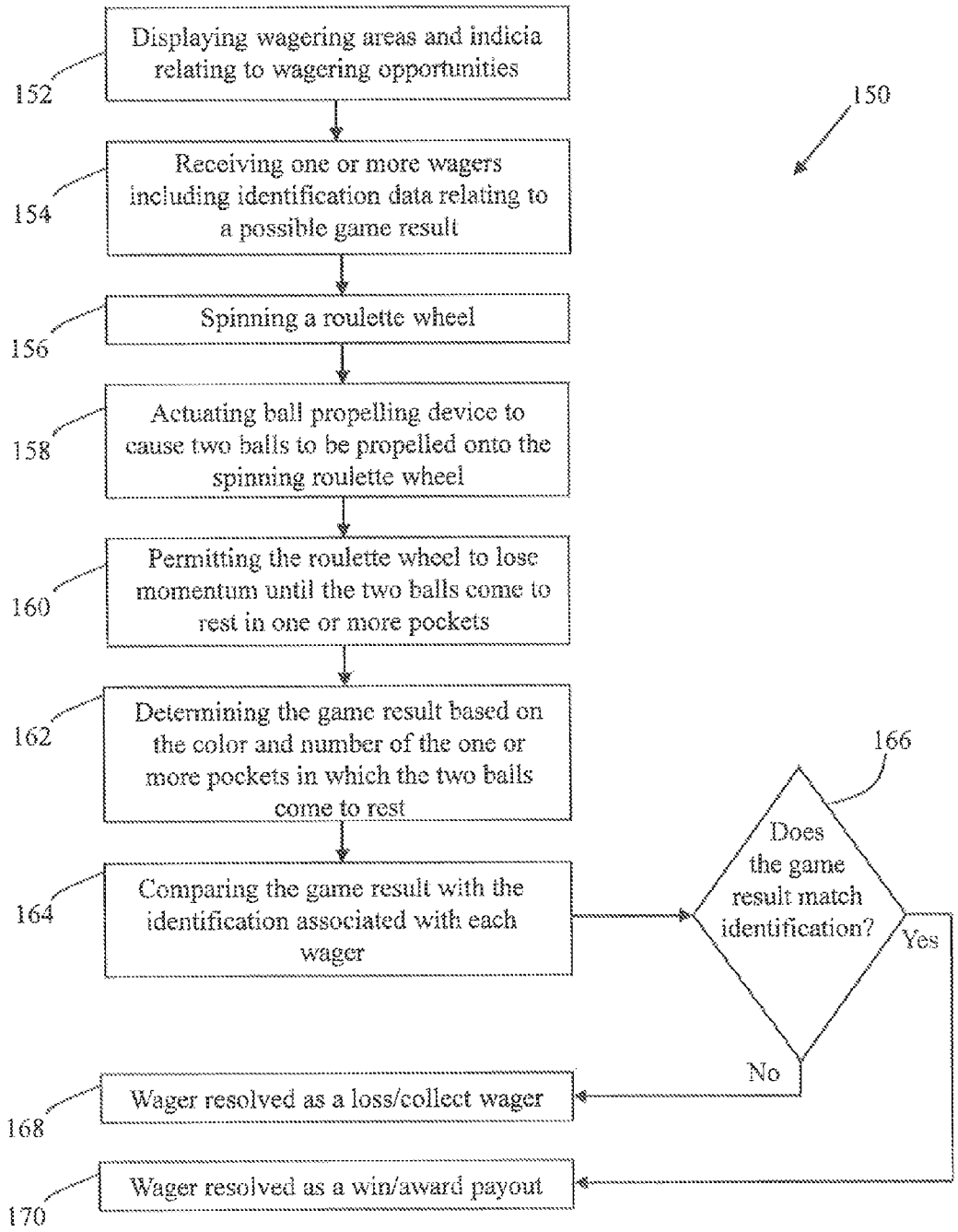
FIG. 9 is a process flow chart depicting an exemplary gaming method according to some embodiments of the invention.

It should be understood that the aforementioned system may be seated on any existing roulette wheel apparatus, such as roulette wheel apparatus 1, and advantageously used in connection with a conventional game of roulette in which a single ball is propelled while the roulette wheel is in motion or other gaming methods where one or more balls are propelled, such as the gaming method illustrated in FIG. 9 and generally designated by the reference numeral 150.

As shown by step 152, method 150 may be facilitated by providing a roulette overlay system such as system 10 and a table layout so that wagering areas and indicia relating to wagering opportunities for the multiball roulette wagering game are displayed, including indicia relating to a doubleball wager.

In step 154 one or more monetary wagers and identification relating to the possible result of the game are received. Each wager includes a monetary amount and identification data relating to at least one the following: a color, a number, a plurality of numbers and a doubleball wager number. Receipt of the wagers is typically accomplished by a gaming chip, money or other identifier being placed by a player on a location on the table layout corresponding to a color, number, plurality of numbers and/or double wager number selected. Once the game begins, any wagers placed are at stake in the game and will be resolved by comparison with the game results as discussed below.

As indicated by step 156, a roulette wheel is made to spin in a first direction, which may be any conventional or unconventional roulette wheel mounted for rotational movement, including both European and American style roulette wheels. It should be understood that the spinning of the roulette wheel may be accomplished by any means, such as by a croupier physically spinning the roulette wheel or through mechanical automation.

As shown by step 158, two balls are propelled onto the spinning roulette wheel. The propelling of the two balls may be carried out by actuating a ball propelling device configured to cause two balls to be propelled through a ball guiding member and onto the spinning roulette wheel in a second direction opposing the first direction, as in the embodiment of the invention discussed above. The actuation of the ball propelling device may be physically triggered through a stationary actuator or by a croupier or a player using a remote actuator.

As shown by step 160, the roulette wheel is permitted to lose momentum so that the two balls will come to rest in one or more pockets on the roulette wheel.

As shown by step 162, the game result is determined based on the color and number of the one or more pockets in which the at least two balls come to rest. In step 164, the game result is compared with the identification associated with each wager. In this embodiment, the doubleball wager is only won if the two balls come to rest in a single pocket corresponding to the doubleball wager number identified by a wager received in step 154.

As shown by steps 166 and 168, if a wager does not match the game result, the wager is collected or lost. As shown by steps 166 and 170, if a wager matches the game result, then the wager is won and a payout amount is awarded.

Figure 10:
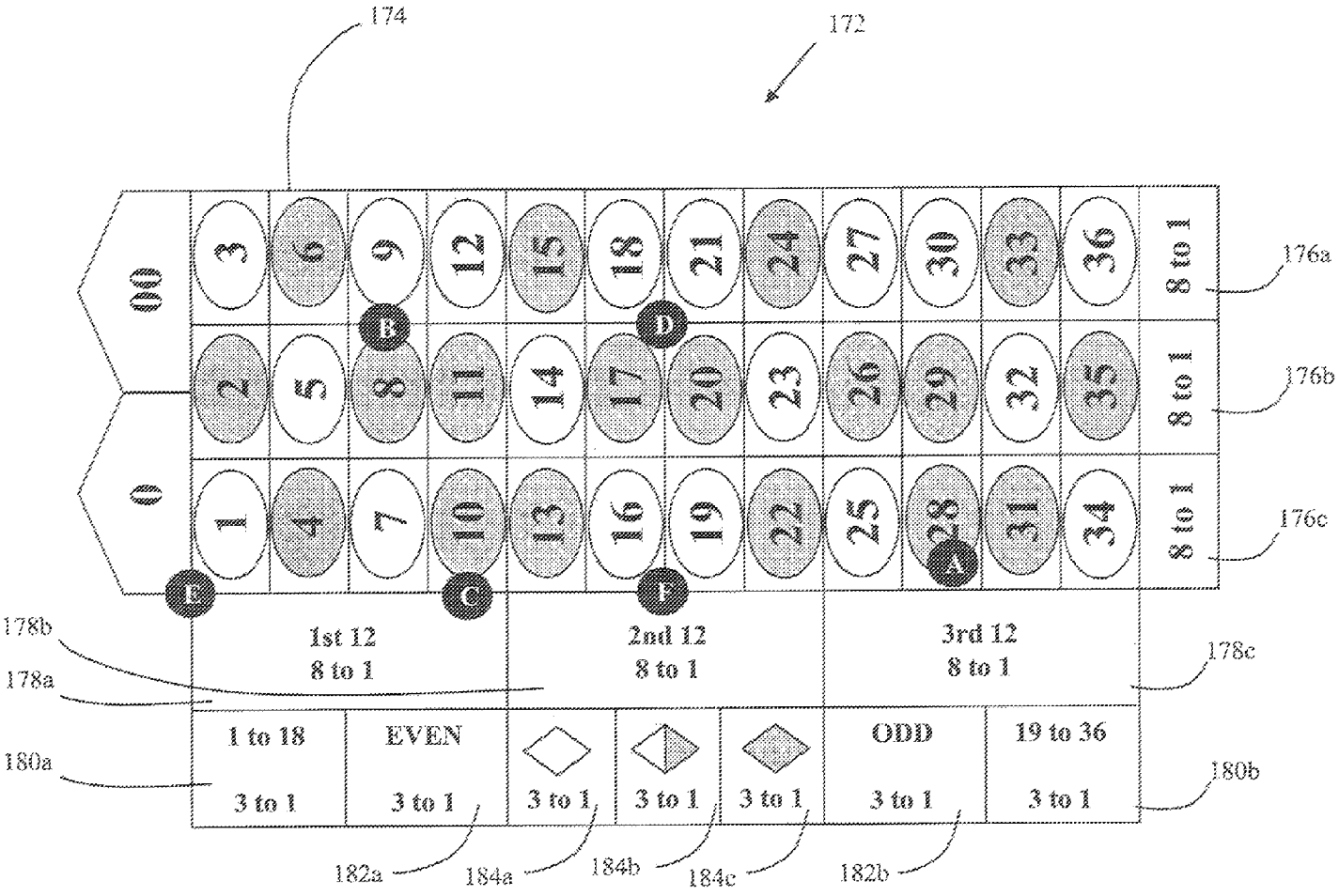
FIGS. 10 and 11 depict an exemplary gaming table layout for facilitating gaming methods according to some embodiments of the invention.

FIG. 10 illustrates an exemplary table layout 172 which may advantageously be used with the roulette overlay system such as system 10 which is capable of propelling one or more balls onto a spinning roulette wheel, or roulette gaming methods which are modified to involve more than one ball in determining the roulette game result, such as gaming method 150.

In this embodiment, layout 172 sets forth wagers and payout awards for two balls to be involved in determining a single roulette game outcome using an American style roulette wheel. Layout 172 includes wagering areas and identifying the wagers and odds as shown in the following table.

Wagering area 174 may be used for various wagers that are resolved by the game result for at least one ball, including one number "straight up" wagers, wherein the wager is placed directly on a number in area 174, and won if the game result includes a ball coming to rest on that number; two number "split" wagers, wherein the wager is split by being placed on a line between two numbers and won if the game result includes a ball coming to rest on either one of the two numbers; three number or "row" wagers, wherein the wager is placed on the line between area 174 and wagering areas 182*a,b,c* and won if the game result includes a ball coming to rest on any one of the three numbers in corresponding row of area 174; four number or "corner" wagers, wherein the wager is placed on the intersecting lines between four numbers in area 174 and won if the game result includes a ball coming to rest on any one of the four numbers; five number wagers, wherein the wager is placed on the intersecting lines between area 174, area 182*a* and numbers 1 and 0, and won if the game result includes a ball coming to rest on any of the numbers 0, 00, 1, 2 or 3; six number wagers, wherein the wager is placed on the intersecting lines between two rows in area 174 and wagering areas 182*a,b,c* and won if the game result includes a ball coming to rest on any of the numbers in the two rows on either side of the intersecting line where the wager is placed.

The following table provides some exemplary odds and identification for wagers placed in wagering area 174.

| Wagering Area | Wager identification area for: | Exemplary payout |
|---|---|---|
| 174 | Straight up one number wagers | 17 to 1 |
| | Two number split wagers | 8 to 1 |
| | Three number "row" wagers | 5 to 1 |
| | Four number "corner" wagers | 4 to 1 |
| | Five number "first 5" wagers (using American wheel) | 3 to 1 |
| | Six number "two row" wagers | 2 to 1 |

For example, as shown in FIG. 10, Wager A would pay 17 to 1 for any ball coming to rest on the number 28; Wager B would pay 8 to 1 for any ball coming to rest on any of the numbers 8 and 9; Wager C would pay 5 to 1 for any ball coming to rest on any of the numbers 10, 11 or 12; Wager D would pay 4 to 1 for any ball coming to rest on any of the numbers 17, 18, 20 or 21; Wager E would pay 3 to 1 for any ball coming to rest on any of the numbers 0, 00, 1, 2 or 3; Wager F would pay 2 to 1 for any ball coming to rest on any of the numbers 16, 17, 18, 19, 20 or 21.

Layout 172 includes the following other wagering areas which are resolved by the outcome of two balls in this embodiment, that is, winning these wagers require that the game result include both balls matching the wager identification.

| Wagering Area | Wager identification area for: | Exemplary payout |
|---|---|---|
| 176a | Column wager (both balls must come to rest on numbers in this column, that is, numbers 3, 6, 9, 12, 15, 18, 21, 24, 27, 30, 33 and 36 to win) | 8 to 1 |
| 176b | Column wager (both balls must come to rest on numbers in this column, that is, numbers 2, 5, 8, 11, 14, 17, 20, 23, 26, 29, 32 and 35 to win) | 8 to 1 |
| 176c | Column wager (both balls must come to rest on numbers in this column, that is, numbers 1, 4, 7, 10, 13, 16, 19, 22, 25, 28, 31 and 34 to win) | 8 to 1 |
| 178a | First 12 numbers wager (both balls must come to rest on numbers from 1-12 to win) | 8 to 1 |
| 178b | Second 12 numbers wager (both balls must come to rest on numbers from 13-24 to win) | 8 to 1 |
| 178c | Third 12 numbers wager (both balls must come to rest on numbers from 25-36 to win) | 8 to 1 |
| 180a | 1-18 numbers wager (both balls must come to rest on numbers 1-18 to win) | 3 to 1 |
| 180b | 19-36 numbers wager (both balls must come to rest on numbers 1-18 to win) | 3 to 1 |
| 182a | Even numbers wager (both balls must come to rest on even numbers to win) | 3 to 1 |
| 182b | Odd numbers wager (both balls must come to rest on odd numbers to win) | 3 to 1 |

-continued

| Wagering Area | Wager identification area for: | Exemplary payout |
|---|---|---|
| 184a | Black wager (both balls must come to rest on black-colored numbers to win) | 3 to 1 |
| 184b | Red and Black wager (one balls must come to rest on a red-colored number and the other must come to rest on a black-colored number to win) | 3 to 1 |
| 184c | Red wager (both balls must come to rest on red-colored numbers to win | 3 to 1 |

Figure 11:
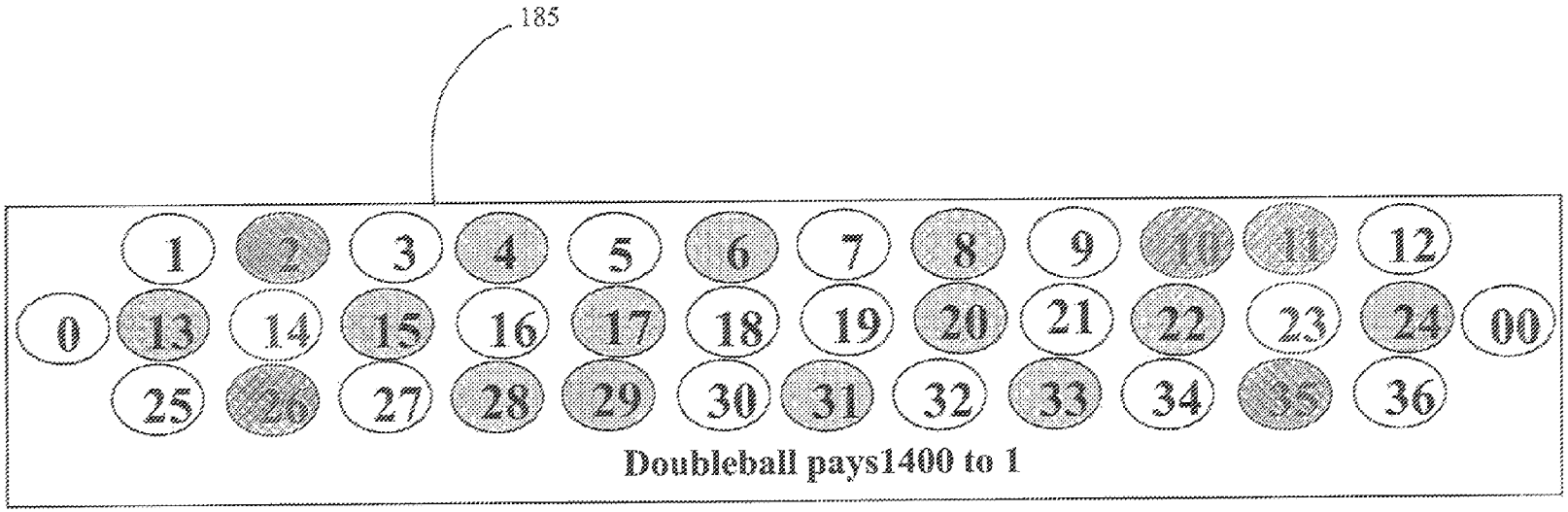

Layout 172 may further include a wagering area 185 which is shown in FIG. 11. Wagering area 185 facilitates the identification of "doubleball" wagers received in the game and may be adjacent to or in a different location as wagering area 174. In this embodiment, a doubleball wager may be received for any of the numbers on the roulette wheel, and is won only if the game result is that both balls come to a rest on the number identified in area 185. Exemplary payout odds may be 1400 to 1 as shown. Alternatively, the doubleball wager may be connected with a progressive system so that all or a part of a progressive payout is awarded upon the doubleball wager being won.

Figure 12:
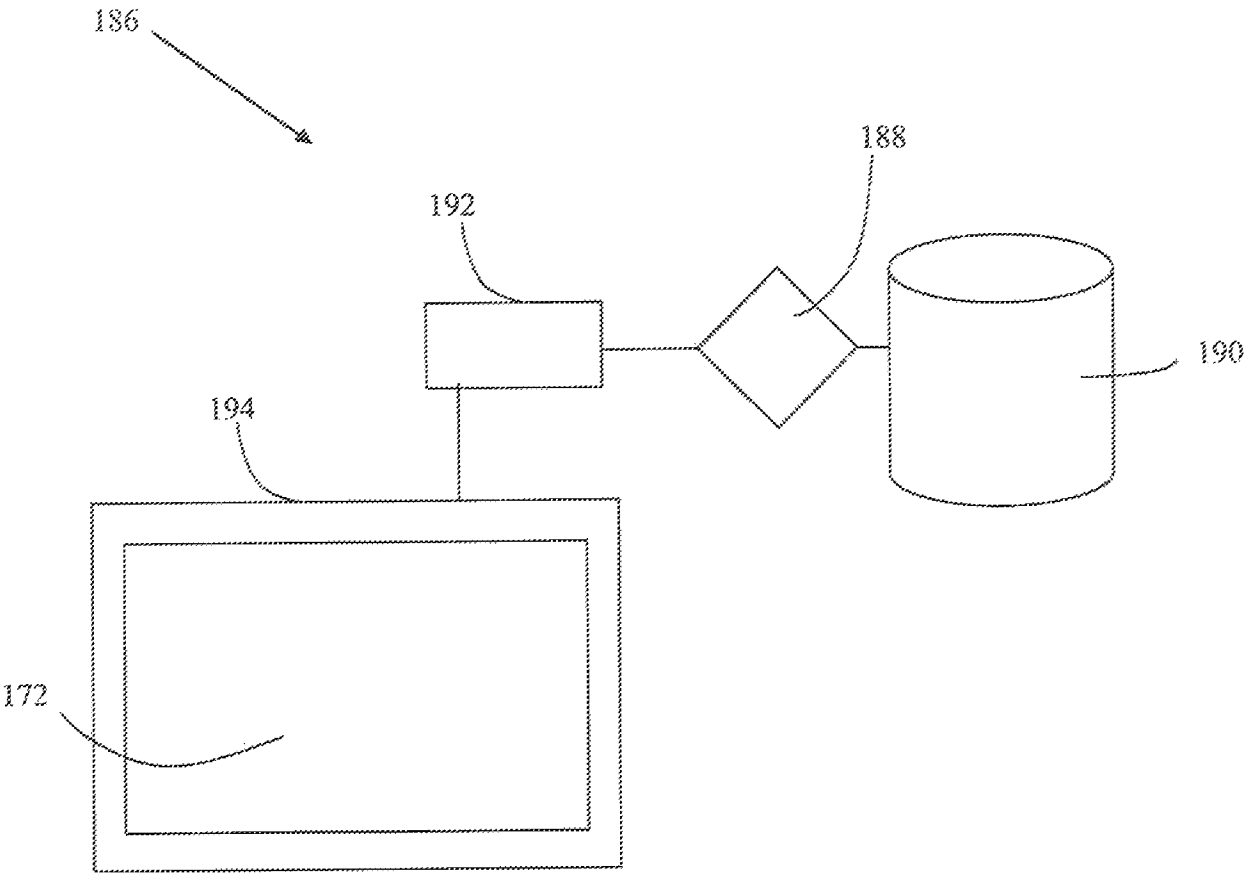
FIG. 12 is a schematic diagram illustrating exemplary system components configured for use to provide a player interface for facilitating gaming methods according to some embodiments of the invention, among other things.

In some embodiments, the table layout may be provided via a computer interface. As shown in FIG. 12, the interface system 186 may be constructed in accordance with some embodiments of the invention and include processing device 188 in communication with a database or memory device 190, communication or data input/output device 192 and a display device 194. In some embodiments, display device 194 is a touch-enabled device and includes a data input device component. Memory device 190 may include data relating to the roulette wagering game and embodiments of the invention as described herein to facilitate game play and wager resolution. Display device 194 may display a virtual representation of a Roulette table layout, such as layout 172 as shown, in order to facilitate receiving wagers and transmitting awards in accordance with any of the embodiments herein, such as method 150, as facilitated by processing device 188, which compares each game result with the wager identification and awards payouts according to the odds for each wager stored in memory device 190. Display 194 may comprise one or more player positions for facilitating play of the game. In additional, display 194 may be located remotely from a roulette table and may further include a portion thereof or there may be a separate display for displaying game results and/or live game play.

Other embodiments of the invention are directed to an apparatus for providing a roulette game which includes a support member including a concave receiving cavity with an outer rim, a ball launching track mounted on the rim including an inlet port and an outlet port, a roulette wheel mounted on the support member for rotational motion and positioned within the concave receiving cavity, wherein the outlet port of the chute is positioned at a radially inner position with respect to the rim. In some embodiments, the aforementioned roulette wheel further includes a plurality of pockets configured and dimensioned to accommodate receiving at least two balls. In some embodiments, the apparatus further includes multiple ball launching tracks. The ball launching track may be straight or include curved portions. The ball launching track may be fully or partially enclosed.

Some embodiments of the invention are directed to an apparatus for retrofitting an existing roulette wheel assembly with a multi-ball launching apparatus. The apparatus of this embodiment includes a support member having a circular receiving portion configured and dimensioned for being mounted over the rim of a roulette wheel assembly in a manner which does not interfere or impede the rotation of the roulette wheel, the circular receiving portion defining a circular hole therein, and a ball launching track mounted on the support member having an outlet positioned within the circular hole. This embodiment may further include various electronics and electromechanical devices which are configured to maintain one or more balls at rest within the launching track and to cause the balls to be propelled from the rest position within the launching track through the outlet. It should be readily apparent that the apparatus may further include a button or other device such as a touch-screen for actuating the electromechanical devices. The actuation device may be mounted on the apparatus or in communication therewith either through wires or wireless means.

It should be understood that systems such as those described herein may be adapted and configured to function independently or may also interact with other systems or applications, such as for example, a casino management system or player tracking system.

Those skilled in the art will readily appreciate that any of the systems and methods of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The system of the invention may be provided on electronic platforms with multiple player positions. In addition, the system of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with useful access thereto or the opportunity to play the game as described herein.

It should be understood that the aforementioned embodiments of the invention may be incorporated in a fully or partially automated or interactive, computerized platform supporting multiple player positions and wagering. It should be readily apparent that additional computerized or manual systems may also be employed in accordance with the invention in order to achieve its full implementation as a system, apparatus or method. It should also be understood that any type of ball may be used, such as standard or non-standard roulette balls.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. A roulette overlay system comprising:

a support body having a top and a bottom and an outer wall, said support body configured to be placed adjacent to an existing roulette wheel such that said support body extends upwardly along an outer portion of said existing roulette wheel and over at least a portion of a rim of said existing roulette wheel without interfering or impeding the rotation of said existing roulette wheel;

a ball propelling device mounted on the support body and including a receiving port for receiving one or more balls to be propelled; and a ball guiding member connected with the ball propelling device for receiving one or more propelled balls and having an end positioned below said rim of said existing roulette wheel for guiding the one or more propelled balls onto the existing roulette wheel.

2. The roulette overlay system as recited in claim 1 wherein said ball guiding member comprises an elongated tube.

3. The roulette overlay system as recited in claim 2 wherein said existing roulette wheel comprises a peripheral rim and said ball guiding member extends along the peripheral rim and said outlet is positioned in said main opening.

4. The roulette overlay system as recited in claim 1 further comprising a remote actuator for causing said ball propelling device to propel one or more balls at substantially the same time.

5. The roulette overlay system as recited in claim 1 wherein said ball propelling device is configured to propel one or more balls based upon an input signal provided to said ball propelling device in response to a user input.

6. A roulette overlay system comprising:

a support member extending over the rim of an existing roulette wheel in a manner which does not interfere or impede the rotation of the roulette wheel; and a multi-ball launching apparatus supported by the support, the multi-ball launching apparatus having an outlet through which balls are launched onto the existing roulette wheel below said rim.

7. The roulette overlay system as recited in claim 6 wherein said support member extends upwardly along an exterior of said existing roulette wheel and wherein said outlet of said multi-ball launching apparatus is located below said rim of said existing roulette wheel and is configured to launch balls onto a ball track of said existing roulette wheel.

8. The roulette overlay system as recited in claim 6 wherein said multi-ball launching apparatus is configured to launch two or more balls substantially simultaneously.

9. The roulette overlay system as recited in claim 6 wherein said support member is generally annular in shape.

10. The roulette overlay system as recited in claim 6 wherein said multi-ball launching apparatus comprise an electro-mechanical device.

11. The roulette overlay system as recited in claim 10 wherein said electro-mechanical device launches said balls in response to an actuation signal.

12. The roulette overlay system as recited in claim 11 wherein said actuation signal is generated in response to a user input to said system.

13. In combination, a roulette wheel and overlay, comprising:

a roulette wheel comprising:

a generally circular support structure having an outer periphery and a top rim;

an inner rotatable wheel located in said support structure, said inner rotatable wheel comprising an outer ring and a plurality of ball receiving pockets located radially inward of said outer ring; and a ball track located below said top rim of said support structure and radially outward of said outer ring of said inner rotatable wheel;

and a roulette wheel overlay comprising:

a support body having a top and a bottom and an outer wall, said support body positioned adjacent to said roulette wheel and extending upwardly along said outer periphery of said support structure and over at least a portion of said top rim thereof without interfering or impeding the rotation of said inner rotatable wheel;

a ball propelling device mounted on the support body and including a receiving port for receiving one or more balls to be propelled; and a ball guiding member connected with the ball propelling device for receiving one or more propelled balls and having an end positioned below said top rim for guiding the one or more propelled balls onto the ball track of the roulette wheel.

14. The combination as recited in claim 13 wherein said ball propelling device comprise an electro-mechanical device.

15. The combination as recited in claim 14 wherein said electro-mechanical device launches said balls in response to an actuation signal.

16. The combination as recited in claim 15 wherein said actuation signal is generated in response to a user input to said system.

17. The combination as recited in claim 13 wherein said ball propelling device is configured to launch at least two balls substantially simultaneously.

18. The combination as recited in claim 13 wherein said ball guiding member comprises an outlet of said ball propelling device.

19. The combination as recited in claim 13 wherein said ball guiding member comprises an elongate tube.

* * * * *